US007631762B2

(12) United States Patent
Liao et al.

(10) Patent No.: US 7,631,762 B2
(45) Date of Patent: Dec. 15, 2009

(54) HAMMOCK-TYPE VIBRATION-ABSORBING AIR SHEATH

(75) Inventors: Chieh Hua Liao, 4F., No. 7, Lane 130, Mincyuan Rd., Sindian, Taipei County 231 (TW); Yaw Shin Liao, Sindian (TW); Yao Chuan Liao, Sindian (TW)

(73) Assignee: Chieh Hua Liao, Sindian, Taipei County (TW)

( * ) Notice: Subject to any disclaimer, the term of this patent is extended or adjusted under 35 U.S.C. 154(b) by 133 days.

(21) Appl. No.: 12/010,861

(22) Filed: Jan. 30, 2008

(65) Prior Publication Data

US 2009/0188830 A1 Jul. 30, 2009

(51) Int. Cl.
*B65D 81/02* (2006.01)

(52) U.S. Cl. ..... 206/522; 206/583; 383/3

(58) Field of Classification Search ..... 206/521, 206/522, 583, 591–594; 383/3, 38–40
See application file for complete search history.

(56) References Cited

U.S. PATENT DOCUMENTS 5,254,026 A * 10/1993 Kaiser ..... 206/522
5,405,000 A * 4/1995 Hagedon et al. ..... 206/583
6,520,333 B1 * 2/2003 Tschantz ..... 206/522
7,168,566 B2 * 1/2007 Anderson et al. ..... 206/522
7,422,109 B2 * 9/2008 Yoshifusa ..... 206/522
7,533,772 B2 * 5/2009 Yoshifusa et al. ..... 206/522
2007/0003170 A1 * 1/2007 Yoshida ..... 383/3

* cited by examiner

*Primary Examiner*—Luan K Bui
(74) *Attorney, Agent, or Firm*—Birch, Stewart, Kolasch & Birch, LLP

(57) ABSTRACT

A hammock-type vibration-absorbing air sheath includes a first buffering wall having at least one first node, and a second buffering wall having at least one second node. The first buffering wall is bent along the first node, and the second buffering wall is bent along the second node. At least one first heat-sealed edge of the first buffering wall is connected to at least one second heat-sealed edge of the second buffering wall by heat sealing means. Thus, a receiving space is formed between the first buffering wall and the second buffering wall, while a buffering sheet is suspended within the receiving space for receiving an article. The buffering sheet is used to absorb vibrations of the article, while the first buffering wall and the second buffering wall are used to protect the article.

16 Claims, 17 Drawing Sheets

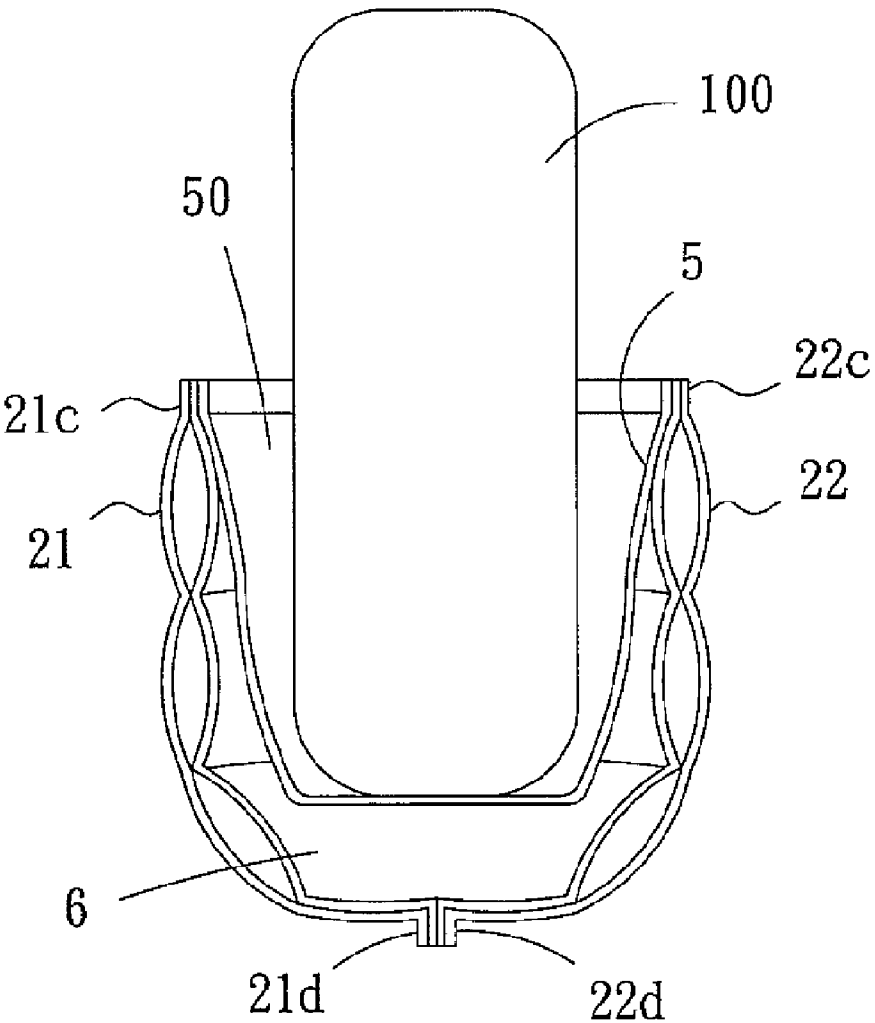
FIG. 4-A

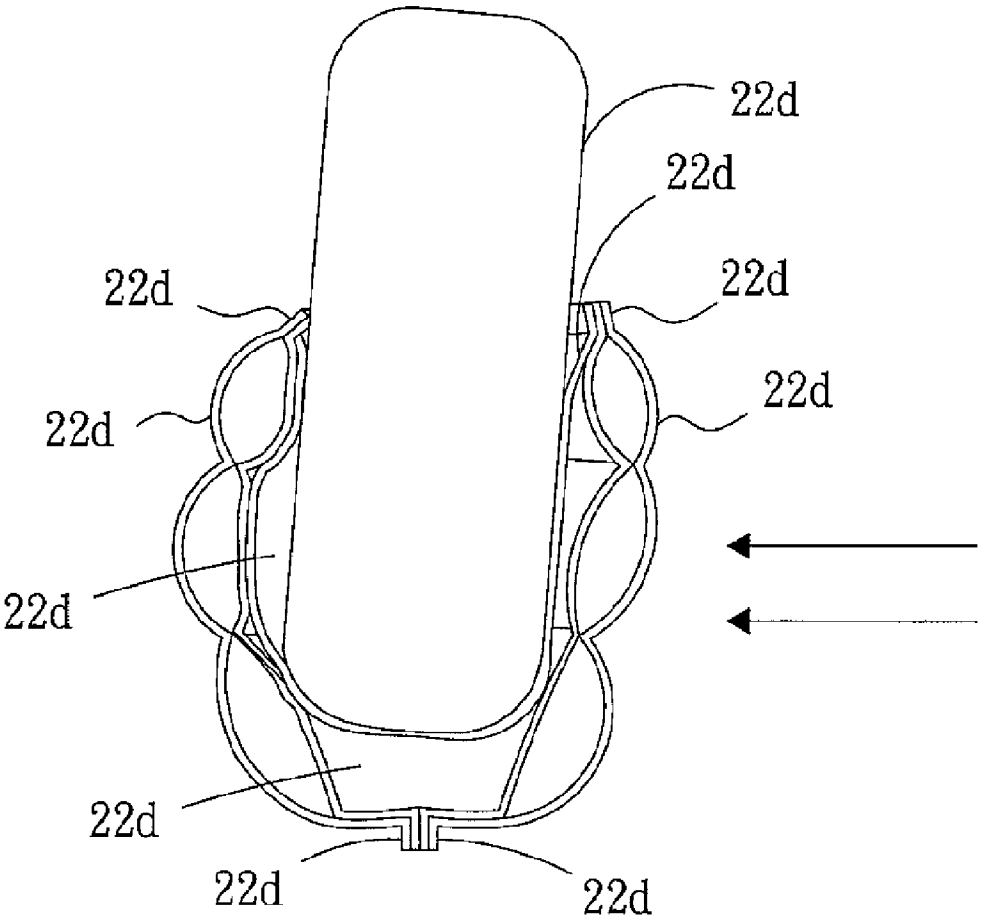
FIG. 4-B

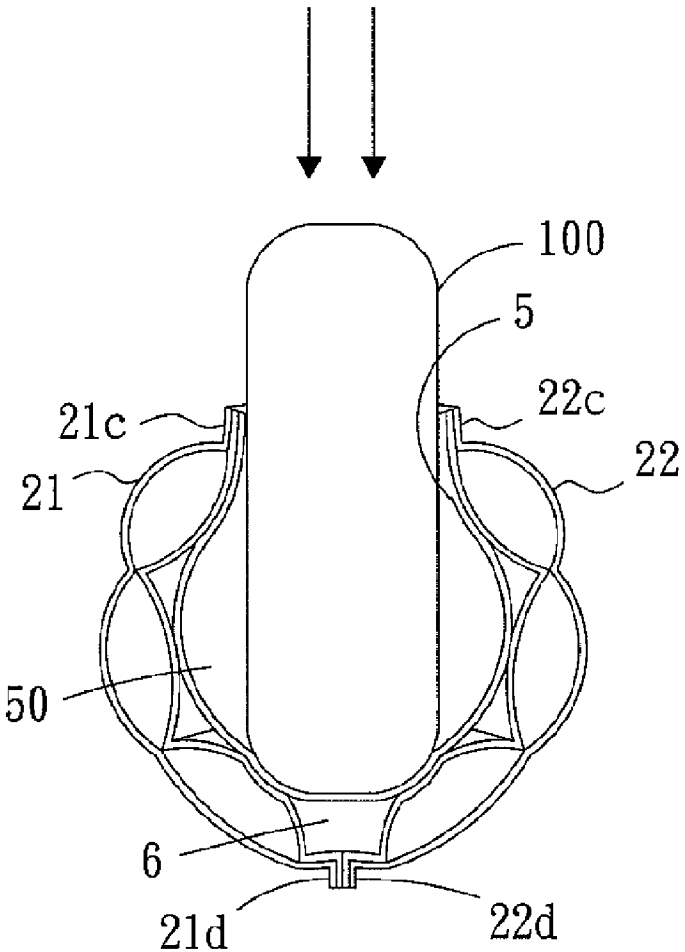
FIG. 4-C

HAMMOCK-TYPE VIBRATION-ABSORBING AIR SHEATH

FIELD OF THE INVENTION

The present invention relates to a vibration-absorbing sheath, and more particularly to a hammock-type vibration-absorbing air sheath.

BACKGROUND OF THE INVENTION

Traditionally, a method for buffering a packaged article generally comprises the steps of: providing a plastic packing sheet provided with a plurality of small air bubbles projected therefrom; and packaging an article in the plastic packing sheet, so as to absorb external vibrations by the plastic packing sheet. However, the small air bubbles of the plastic packing sheet only can absorb limited vibrations, but can not provide an enough buffering effect when a greater vibration or impact load is exerted. To solve the foregoing problem, an air packing bag is developed to be used as a buffering material for packaging.

The air packing bag uses air as a buffering medium of an article, so as to provide a buffering effect for protecting the article. However, there may be some shake or impact during transportation the article, such that the air packing bag made of polyethylene (PE) may be easily punctured by a sharp corner or a metal joint of the article. Once there is a punctured hole on the air packing bag, the air in the air packing bag may be leaked out, so that the packaged article is easily damaged or scratched. Such air packing bag and the equivalents thereof are disclosed in U.S. Pat. No. 4,850,912, entitled "Container for sealingly containing a fluid"; U.S. Pat. No. 5,261,466, entitled "Process for continuously filling fluid into a plurality of closed bags"; and Japanese Utility Model Publication Patent No. 5-95851, entitled "Sealing bag for containing a fluid".

As described above, it is important for the inventor of the present invention and related manufacturers to think how to improve the structure of the air packing bag for solving the problem of reducing the buffering protection due to leaking air in the air packing bag, in order to provide the better vibration-absorbing buffering effect.

SUMMARY OF THE INVENTION

A primary object of the present invention is to provide a hammock-type vibration-absorbing air sheath, which is used to package an article for providing a buffering protection for the article. The vibration-absorbing air sheath comprises: a first buffering wall having at least one first heat-sealed edge, wherein the first buffering wall is partitioned into a plurality of air columns by a plurality of air column lines which are vertical to the first heat-sealed edge and formed by heat sealing means; a second buffering wall having at least one second heat-sealed edge connected to the first heat-sealed edge by heat sealing means, wherein the second buffering wall is partitioned into a plurality of air columns by a plurality of air column lines which are vertical to the second heat-sealed edge and formed by heat sealing means; at least one first node formed on the first buffering wall so that the first buttering wall can be bent along the first node; at least one second node formed on the second buffering wall so that the second buffering wall can be bent along the second node; a third buffering wall connected between the first buffering wall and the second buffering wall by bending the first buffering wall and the second buffering wall; a receiving space formed between the first buffering wall and the second buffering wall by bending the first buffering wall and the second buffering wall; and a buffering sheet having a first side edge connected to the first buffering wall via the first heat-sealed edge by heat sealing means and a second side edge connected to the second buffering wall via the second heat-sealed edge by heat sealing means. Furthermore, the buffering sheet having the two heat-sealed side edges is partially heat-sealed along the air column lines of the first buffering wall and the second buffering wall by heat sealing means, while the buffering sheet is not heat-sealed along a middle portion of the air column lines, so that a bottom portion of the buffering sheet is suspended. As a result, the buffering sheet is suspended within the receiving space for receiving the article, in order to absorb a vibration of the article and protect the article with a buffering of the first buffering wall, the second buffering wall, and the third buffering wall.

According to a preferred embodiment of the present invention, it can provide a buffering protection for the article when the vibration-absorbing air sheath is used to package the article. If the article is shook during transportation, the buffering sheet of the vibration-absorbing air sheath can be used to absorb the vibration of the article, while the first buffering wall and the second buffering wall can be used to protect the article, so as to provide dual vibration-absorbing buffering effects. Furthermore, the structure of the vibration-absorbing air sheath can prevent the article from being in direct contact with the first buffering wall, the second buffering wall, and the third buffering wall, so as to keep the buffering protection from being impaired by the article's puncturing the first, second and third buffering wall, which leads to air leak.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 4A is a first cross-sectional view of the hammock-type vibration-absorbing air sheath showing the same receiving an article according to the first preferred embodiment of the present invention;

FIG. 4B is a second cross-sectional view of the hammock-type vibration-absorbing air sheath showing the same receiving the article according to the first preferred embodiment of the present invention;

FIG. 4C is a third cross-sectional view of the hammock-type vibration-absorbing air sheath showing the same receiving the article according to the first preferred embodiment of the present invention;

DETAILED DESCRIPTION OF THE PREFERRED EMBODIMENTS

Figure 1:
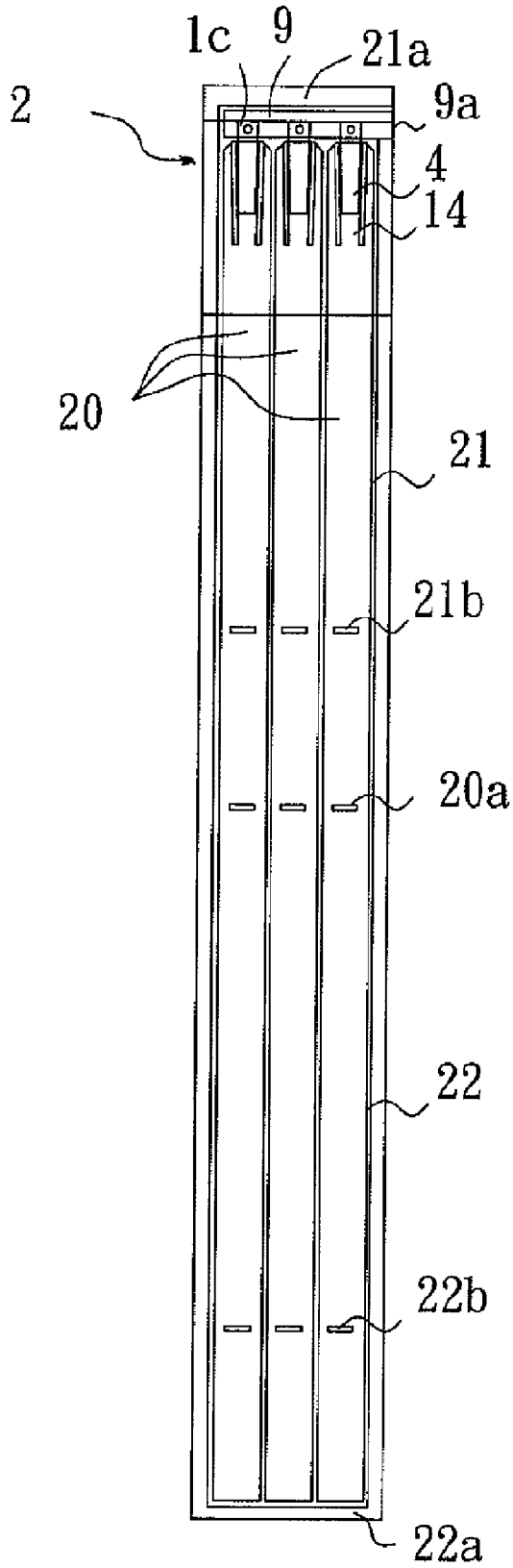
FIG. 1 is a plane view of a hammock-type vibration-absorbing air sheath before air inflation according to a first preferred embodiment of the present invention.
Figure 2:
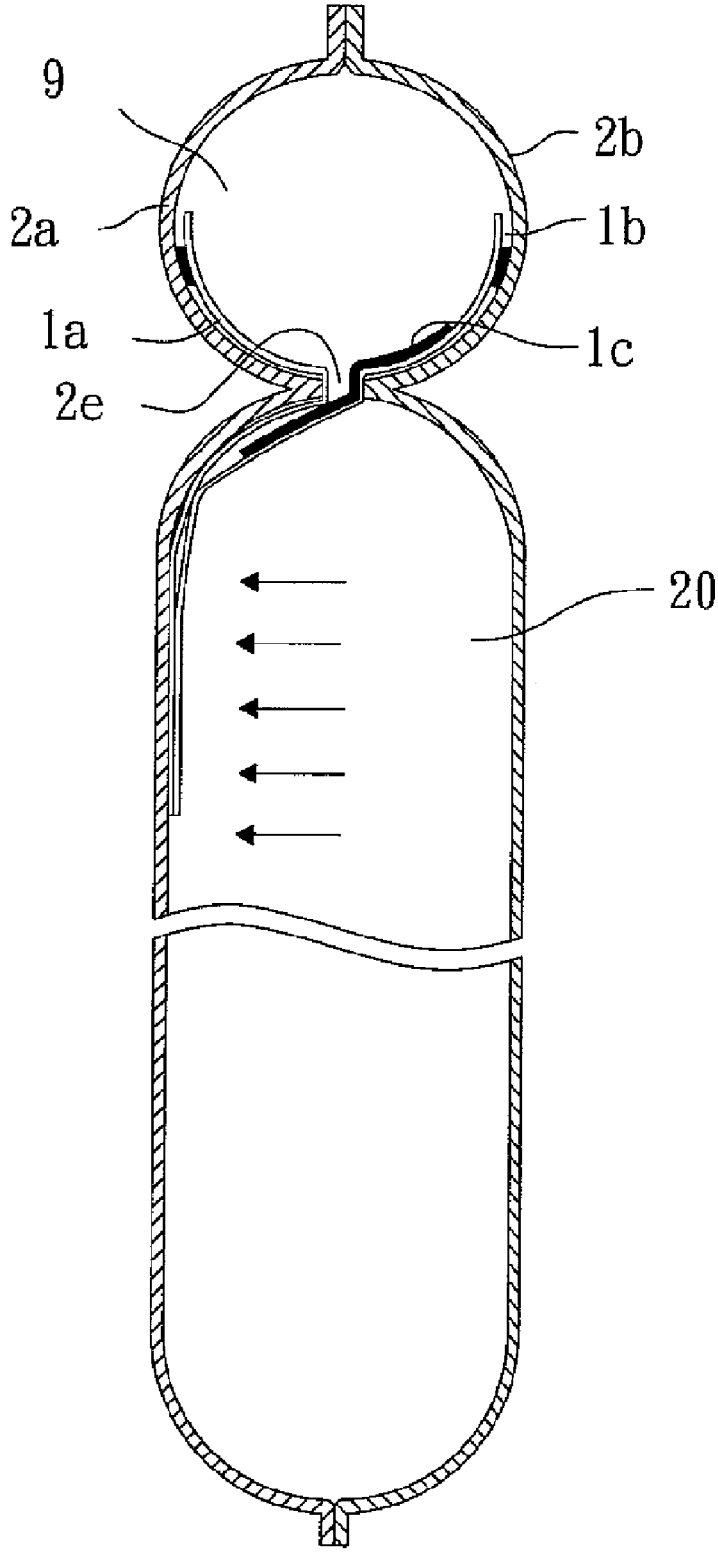
FIG. 2 is a cross-sectional view of the hammock-type vibration-absorbing air sheath after air inflation according to the first preferred embodiment of the present invention.
Figure 3:
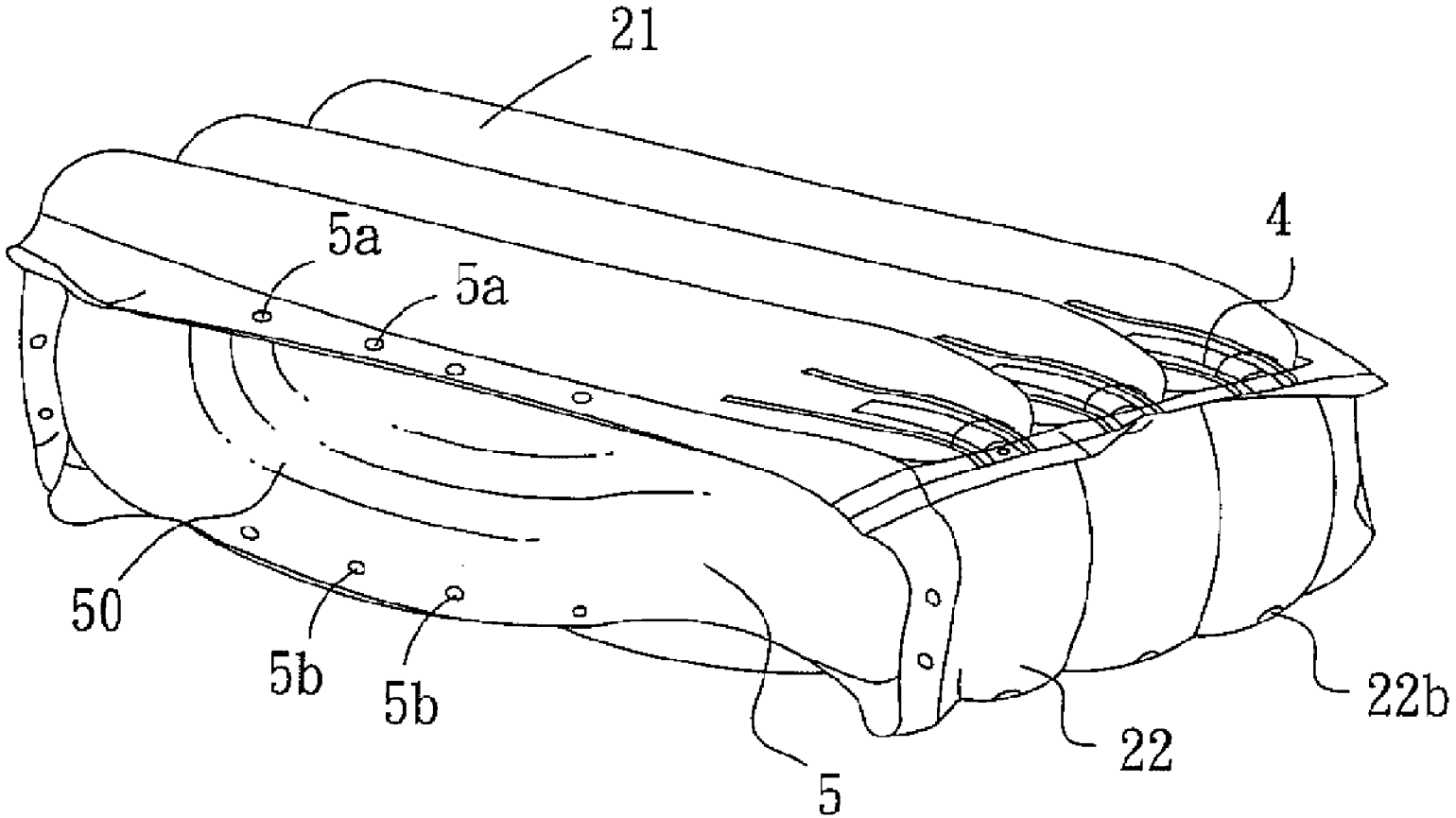
FIG. 3 is a perspective view of the hammock-type vibration-absorbing air sheath after air inflation according to the first preferred embodiment of the present invention.

Referring now to FIGS. 1, 2, 3, and 4A, a hammock-type vibration-absorbing air sheath according to a first preferred embodiment of the present invention is illustrated, wherein FIG. 1 is a plane view before air (or a suitable gas) inflation, FIG. 2 is a cross-sectional view after air inflation, FIG. 3 is a perspective view after air inflation, and FIG. 4A is a first cross-sectional view when receiving an article.

As shown, the hammock-type vibration-absorbing air sheath comprises an air-column sheet 2 and a buffering sheet 5. The air-column sheet 2 is constructed with a plurality of air columns 20. The air columns 20 are formed with a plurality of bending points 20*a*, and the air columns 20 can be bent along the bending points 20*a* to define a first buffering wall 21 and a second buffering wall 22, wherein the first buffering wall 21 and the second buffering wall 22 are in communication with each other. The first buffering wall 21 is provided with a first heat-sealed edge 21*a* on a side edge thereof, and a plurality of first nodes 21*b*. The second buffering wall 22 is provided with a second heat-sealed edge 22*a* on a side edge thereof, and a plurality of second nodes 22*b*. The first buffering wall 21 can be bent along the first nodes 21*b*, and the second buffering wall 22 can be bent along the second nodes 22*b*. Then, the first heat-sealed edge 21*a* and the second heat-sealed edge 22*a* can be connected to each other by heat sealing means, so as to define a receiving space 6 between the first buffering wall 21 and the second buffering wall 22. The receiving space 6 is substantially quadrilateral, and the shape thereof can be slightly varied with the locations and numbers of the first nodes 21*b* and the second nodes 22*b*, or with bending angles of the first buffering wall 21 and the second buffering wall 22. For example, the shape of the receiving space 6 can be varied with the extent to which the first buffering wall 21 is bent along the first nodes 21*b*, or with the extent to which the second buffering wall 22 is bent along the second nodes 22*b*.

The air-column sheet 2 is formed by two outer films 2*a*, 2*b* connected to each other by heat sealing means. The two outer films 2*a*, 2*b* can be preferably made of polyethylene (PE).

The buffering sheet 5 is made of flexible material, such as polyvinylchloride (PVC), polypropylene (PP), expanded polyethylene (EPE), expanded polypropylene (EPP), fabric, foam material, polyethylene (PE) sheet provided with small air bubbles projected therefrom, corrugated paper, paper, or paper-like material. The buffering sheet 5 has a first side edge formed with a plurality of heat-sealed points 5*a* by heat sealing means for mounting on the first buffering wall 21, and a second side edge formed with a plurality of heat-sealed points 5*b* by heat sealing means for mounting on the second buffering wall 22. Thus, the buffering sheet 5 can be suspended within the receiving space 6 and substantially similar to a hammock structure. Meanwhile, the buffering sheet 5 has a central portion defining an accommodating space 50 for accommodating an article 100, wherein the accommodating space 50 is formed between two folded halves of the buffering sheet 5.

According to the first preferred embodiment of the present invention, the hammock-type vibration-absorbing air sheath further comprises an air-filling channel 9, wherein the two outer films 2*a*, 2*b* are connected to each other by heat sealing means, so as to define an air flowing space therebetween, i.e. the air-filling channel 9. The air-filling channel 9 is formed on the side edge of the first buffering wall 21, and used to fill air into the first buffering wall 21 and the second buffering wall 22. In this manner, the first buffering wall 21 and the second buffering wall 22 will be filled with air and inflated, in order to provide a vibration-absorbing buffering effect.

Furthermore, according to the first preferred embodiment of the present invention, the hammock-type vibration-absorbing air sheath further comprises at least one serial check valve system 4 which is constructed by connecting two inner films 1*a*, 1*b* to each other by heat sealing means. The serial check valve system 4 is used to communicate the air-filling channel 9 with the first buffering wall 21. The air in the air-filling channel 9 is flowed into the first buffering wall 21 through the serial check valve system 4. Then, the serial check valve system 4 can seal the first buffering wall 21, so as to prevent the air in the first buffering wall 21 from leaking out. Moreover, a heatproof material 1*c* is applied between the two inner films 1*a*, 1*b*, and a plurality of air inlets 2*e* are formed between the two inner films 1*a*, 1*b* where the two inner films 1*a*, 1*b* are not connected to each other by heat sealing means. Each of the air inlets 2*e* is corresponding to each of the air columns 20, and communicated with one air channel 14. The air channel 14 is sandwiched between the two inner films 1*a*, 1*b*, wherein at least one of the two inner films 1*a*, 1*b* is coated with the heatproof material 1*c* between the two inner films 1*a*, 1*b*, and the two inner films 1*a*, 1*b* are connected to each other by heat sealing means. After the air flows through an air-filling opening 9*a* and finishes inflating the air-filling channel 9, the two outer films 2*a*, 2*b* must be pulled outward and away from each other, in order to open the air inlets 2*e*. In this manner, the air will be filled into the air columns 20 along the air channel 14, so as to inflate the air columns 20. After the air columns 20 are inflated, the inner air pressure of the air columns 20 presses the two inner films 1*a*, 1*b*, so that the two inner films 1*a*, 1*b* will be tightly attached to the two outer films 2*a*, 2*b*. (Alternatively, according to another different structure, the two inner films 1*a*, 1*b* can only be suspended within the air columns 20 instead of being tightly attached to the two outer films 2*a*, 2*b*.) Finally, the air channel 14 will be closed, and the air columns 20 will be sealed, so that the air in the air columns 20 can be prevented from leaking out, in order to ensure the air sealing effect.

According to the first preferred embodiment of the present invention, the first buffering wall 21 further comprises a first connection edge 21*c* substantially vertical to the first heat-sealed edge 21*a*, and the second buffering wall 22 further comprises a second connection edge 22*c* substantially vertical to the second heat-sealed edge 22*a*. The first side edge and the second side edge of the buffering sheet 5 are attached to the first connection edge 21*c* and the second connection edge 22*c* by heat sealing means, respectively. Furthermore, the first buffering wall 21 further comprises a first bottom edge 21*d* substantially vertical to the first heat-sealed edge 21*a*, and the second buffering wall 22 further comprises a second bottom edge 22*d* substantially vertical to the second heat-sealed edge 22*a*. The first bottom edge 21*d* and the second bottom edge 22*d* can be connected to each other by heat sealing means, so as to seal the receiving space 6. Especially, an interval is defined between the buffering sheet 5 and a heat-sealed connection portion of the first bottom edge 21*d* and the second bottom edge 22*d*. The interval can be used to prevent the buffering sheet 5 from being in direct contact with the air columns 20 close to the first bottom edge 21*d* and the second bottom edge 22*d*.

Referring now to FIGS. 4A, 4B, and 4C, a first, a second, and a third cross-sectional views of the hammock-type vibration-absorbing air sheath showing the air sheath receiving the article according to the first preferred embodiment of the present invention are provided.

As shown, when the hammock-type vibration-absorbing air sheath of the present invention is used to package the article 100, it can provide a buffering protection for the article 100. Even though the buffering sheet 5 is shifted downward due to the press of the article 100, the interval still can keep the buffering sheet 5 away from the air columns 20 close to the first bottom edge 21*d* and the second bottom edge 22*d*. When the article 100 is shook during transportation, the buffering sheet 5 can be used to is absorb the vibration of the article 100, while the first buffering wall 21 and the second buffering wall 22 located on two sides of the article 100 can be used to protect the article 100, so as to provide a buffering protection for the article 100. If the article 100 is violently shook to generate a force biasing downward against the buffering sheet 5, the air columns 20 on the bottom of the first buffering wall 21 and the second buffering wall 22 can be used to absorb the vibration of the article 100, so as to provide dual vibration-absorbing buffering effects. Furthermore, the vibration-absorbing air sheath of the present invention can prevent the article 100 from directly contacting with the first buffering wall 21 and the second buffering wall 22, so as to avoid reducing the buffering protection caused by that the article 100 punctures the first buffering wall 21 and the second buffering wall 22 to leak the air out.

Figure 5:
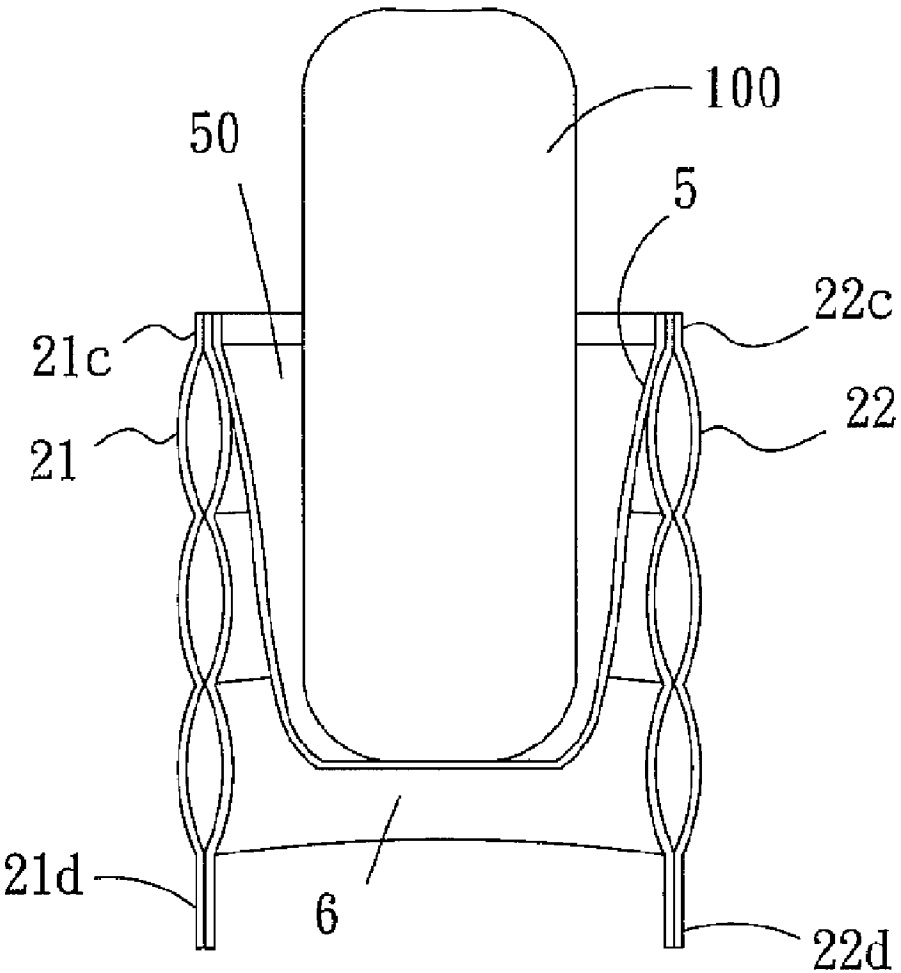
FIG. 5 is a cross-sectional view of a hammock-type vibration-absorbing air sheath showing the same receiving an article according to a second preferred embodiment of the present invention.

Referring now to FIG. 5, a cross-sectional view of a hammock-type vibration-absorbing air sheath showing the same receiving an article according to a second preferred embodiment of the present invention is illustrated.

As shown, in the second preferred embodiment, the first bottom edge 21*d* of the first buffering wall 21 and the second bottom edge 22*d* of the second buffering wall 22 can be separated from each other instead of being connected to each other by heat sealing means. Thus, the receiving space 6 will be an open space. When the buffering sheet 5 receives the article 100, a force may be generated to bias downward against the buffering sheet 5, and the air columns 20 still can absorb the vibration of the article 100, so as to provide the buffering protection for the article 100.

Figure 6:
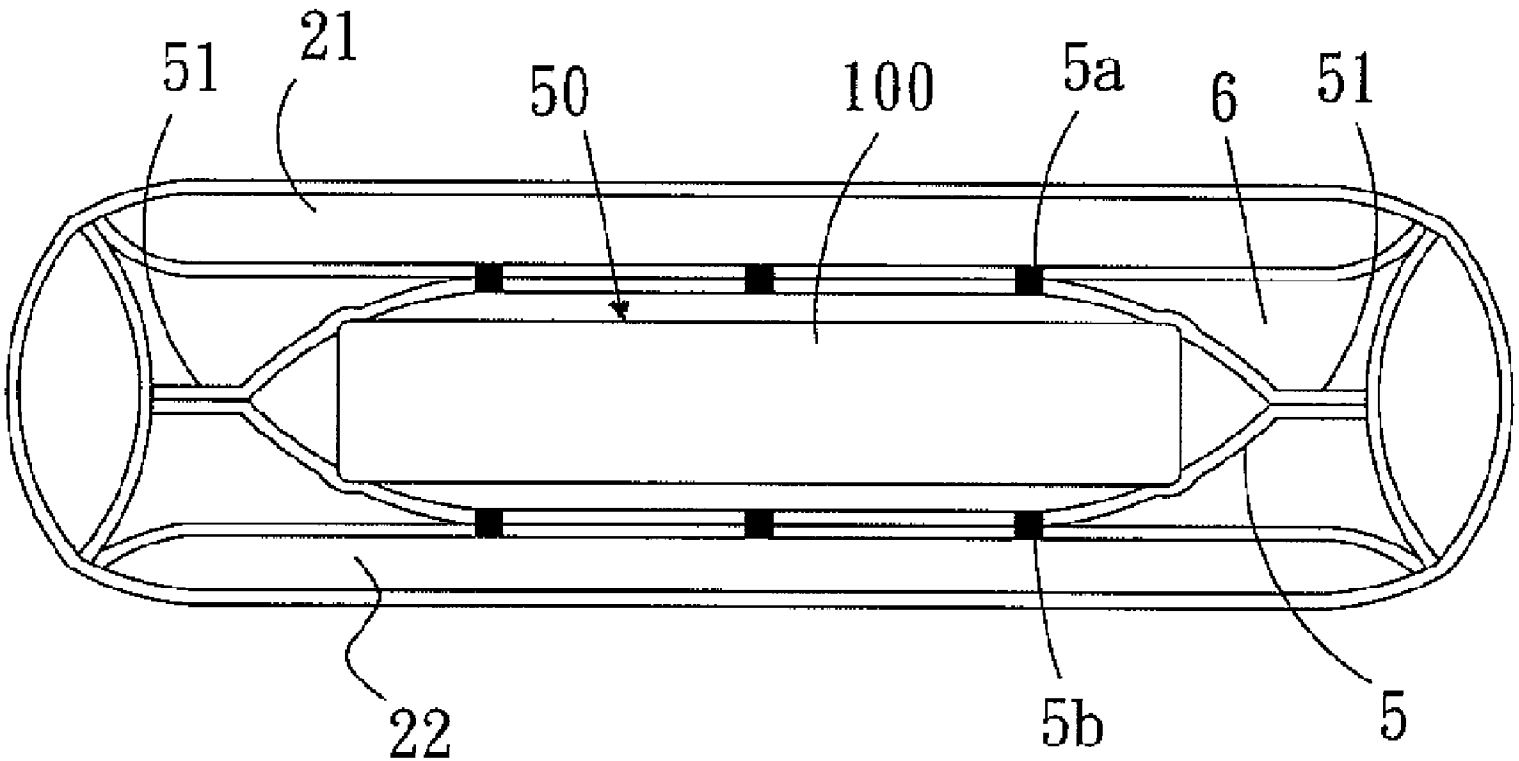
FIG. 6 is another cross-sectional view of the hammock-type vibration-absorbing air sheath showing the same receiving the article according to the second preferred embodiment of the present invention.

Referring now to FIG. 6, another cross-sectional view of the hammock-type vibration-absorbing air sheath showing the same receiving the article according to the second preferred embodiment of the present invention is illustrated.

As shown, the hammock-type vibration-absorbing air sheath of the present invention further comprises two connection portions 51 formed on two ends of the buffering sheet 5, wherein the two connection portions 51 are two folded connection portions of the buffering sheet 5. When the article 100 is shook to cause the buffering sheet 5 to shift leftward and rightward, the buffering sheet 5 is firstly used to buffer and absorb the vibrations of the article 100, and then the first buffering wall 21 and the second buffering wall 22 are used to protect the article 100. Thus, the present invention can provide dual buffering effects of absorbing vibrations for the article 100. Furthermore, the buffering sheet 5 of the present invention can prevent the article 100 from directly contacting with the first buffering wall 21 and the second buffering wall 22, so as to avoid reducing the buffering protection caused by that the article 100 punctures the first buffering wall 21 and the second buffering wall 22 to leak the air out.

Figure 7:
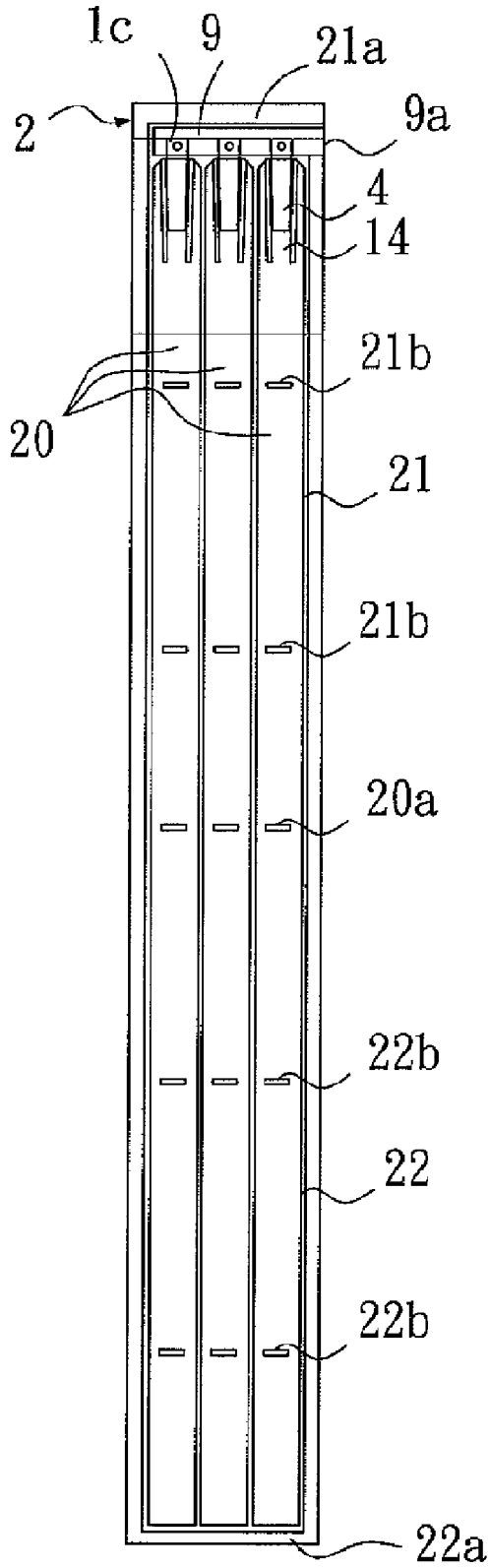
FIG. 7 is a plane view of a hammock-type vibration-absorbing air sheath before air inflation according to a third preferred embodiment of the present invention.
Figure 8:
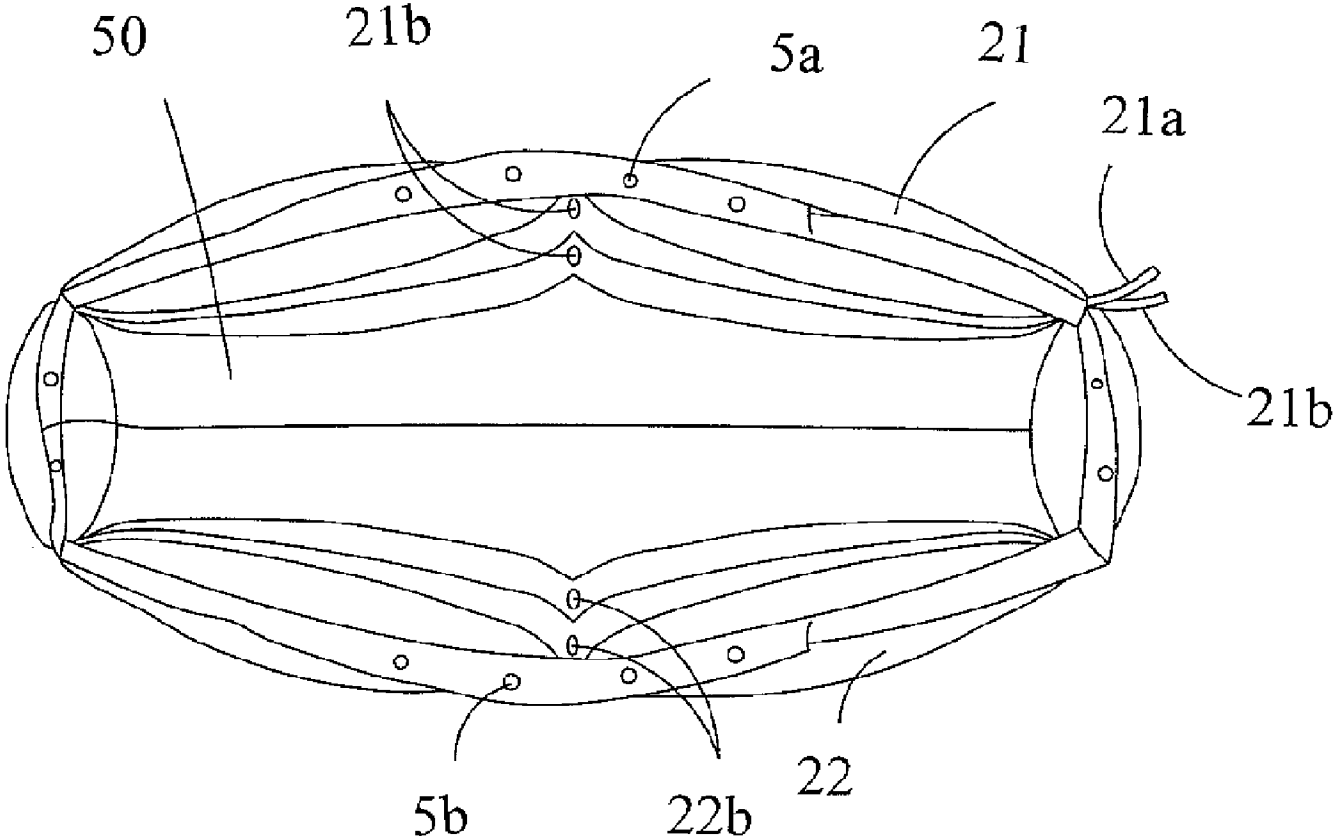
FIG. 8 is a cross-sectional view of the hammock-type vibration-absorbing air sheath showing the same receiving an article according to the third preferred embodiment of the present invention.

Referring now to FIGS. 7 and 8, a hammock-type vibration-absorbing air sheath according to a third preferred embodiment of the present invention is illustrated; wherein FIG. 7 is a plane view before air inflation, and FIG. 8 is a cross-sectional view showing the same receiving an article.

As shown, the first buffering wall 21 is provided with a plurality of first nodes 21*b*, and the second buffering wall 22 is provided with a plurality of second nodes 22*b*. The first buffering wall 21 can be bent along the first nodes 21*b*, and the second buffering wall 22 can be bent along the second nodes 22*b*. A receiving space 6 is defined between the first buffering wall 21 and the second buffering wall 22 (as shown in FIG. 4A). The receiving space 6 is substantially hexagonal, and the shape thereof can be slightly varied according to the positions and the amounts of the first nodes 21*b* and the second nodes 22*b*, or according to the bending angles of the first buffering wall 21 and the second buffering wall 22.

According to the structure of the hammock-type vibration-absorbing air sheath in the preferred embodiments of the present invention, the buffering sheet 5 is connected to and mounted on the first buffering wall 21 and the second buffering wall 22 by heat sealing means. Alternatively, the buffering sheet 5 may be selected from an extension sheet extended from at least one side edge of the first buffering wall 21 and the second buffering wall 22. According to the present invention, it is to be noted that the buffering sheet 5 may also be selected from other equivalent structural improvement or variation, without limitation.

According to the structure of the hammock-type vibration-absorbing air sheath in the preferred embodiments of the present invention, the first buffering wall 21 and the second buffering wall 22 are formed and exemplified by bending the common air-column sheet 2, without limitation. Alternatively, the first buffering wall 21 and the second buffering wall 22 also can be selected from two separate air-column sheets 2, each of which is provided with an air-filling channel 9 and a plurality of serial check valves system 4.

Figure 9:
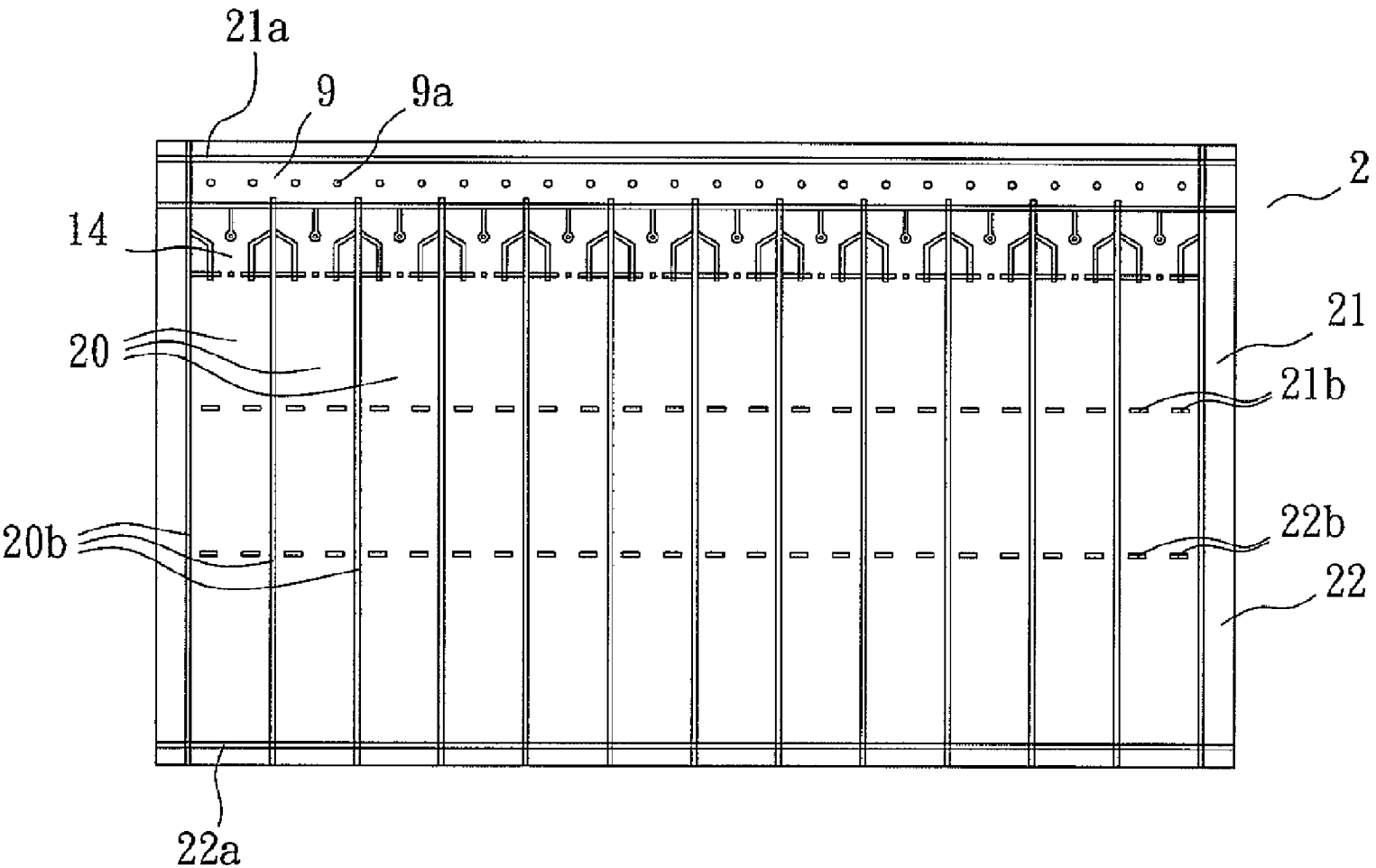
FIG. 9 is a plane view of a hammock-type vibration-absorbing air sheath before air inflation according to a fourth preferred embodiment of the present invention.
Figure 10:
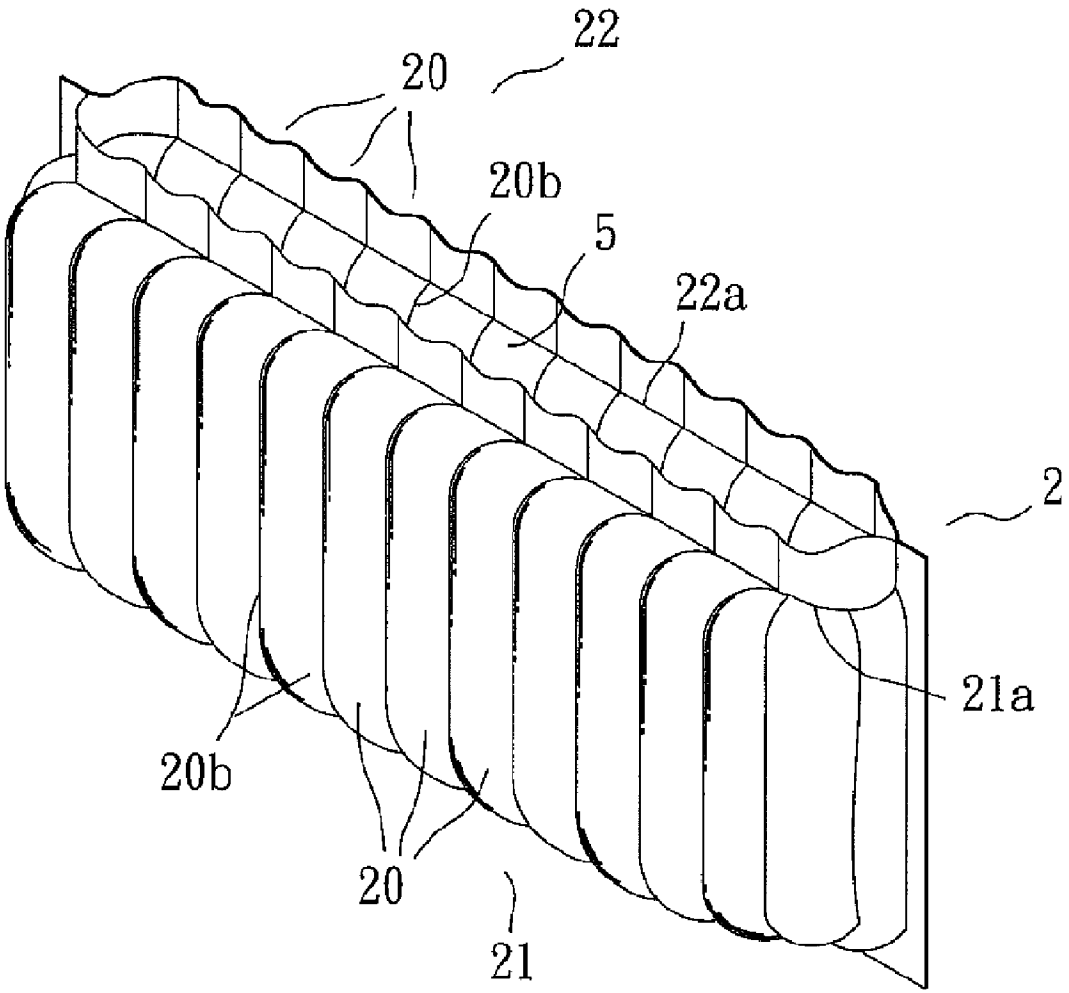
FIG. 10 is a perspective view of the hammock-type vibration-absorbing air sheath after air inflation according to the fourth preferred embodiment of the present invention.
Figure 11:
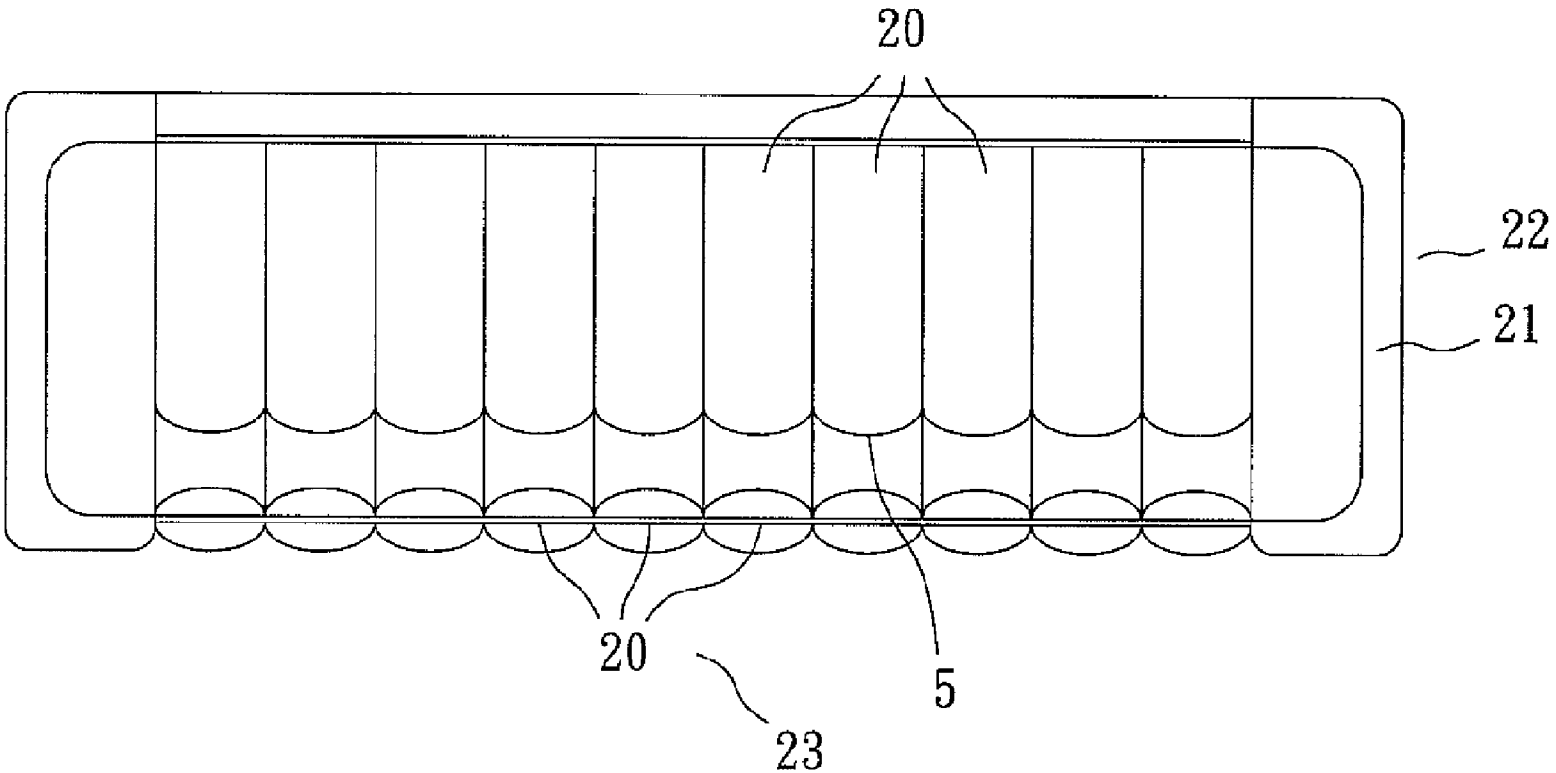
FIG. 11 is a side view of the hammock-type vibration-absorbing air sheath after air inflation according to the fourth preferred embodiment of the present invention.
Figure 12:
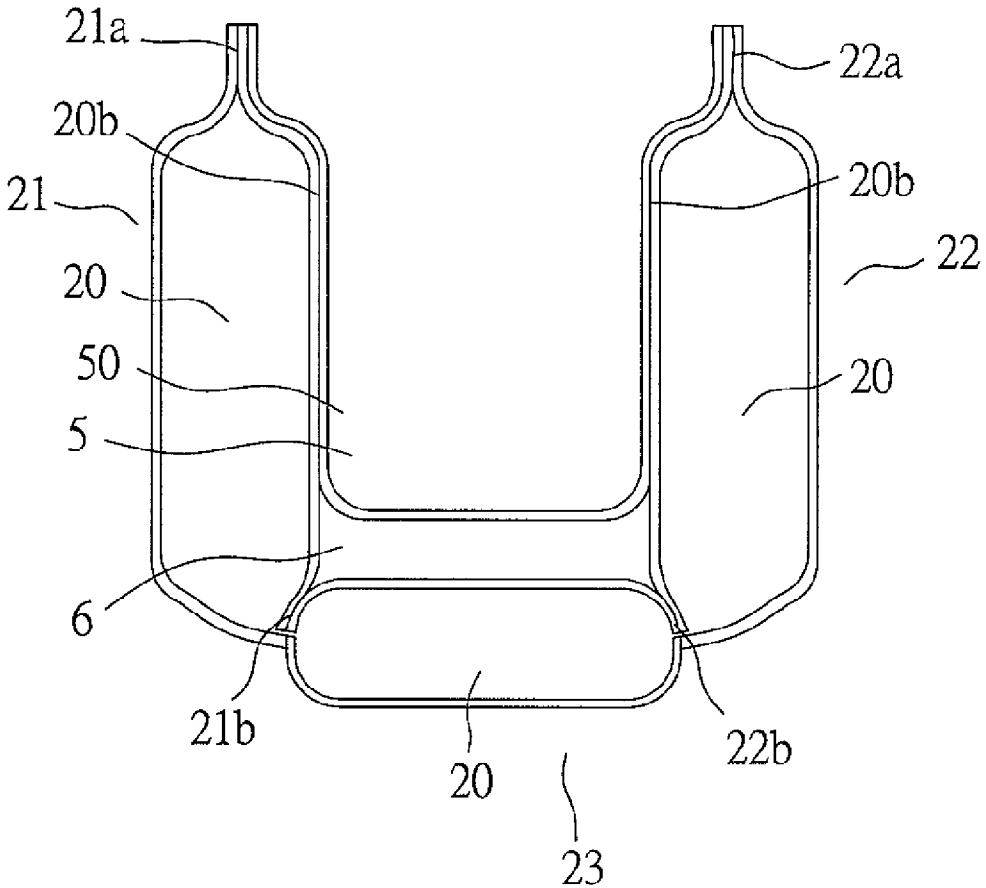
FIG. 12 is a first cross-sectional view of the hammock-type vibration-absorbing air sheath showing the same before receiving an article according to the fourth preferred embodiment of the present invention.
Figure 13:
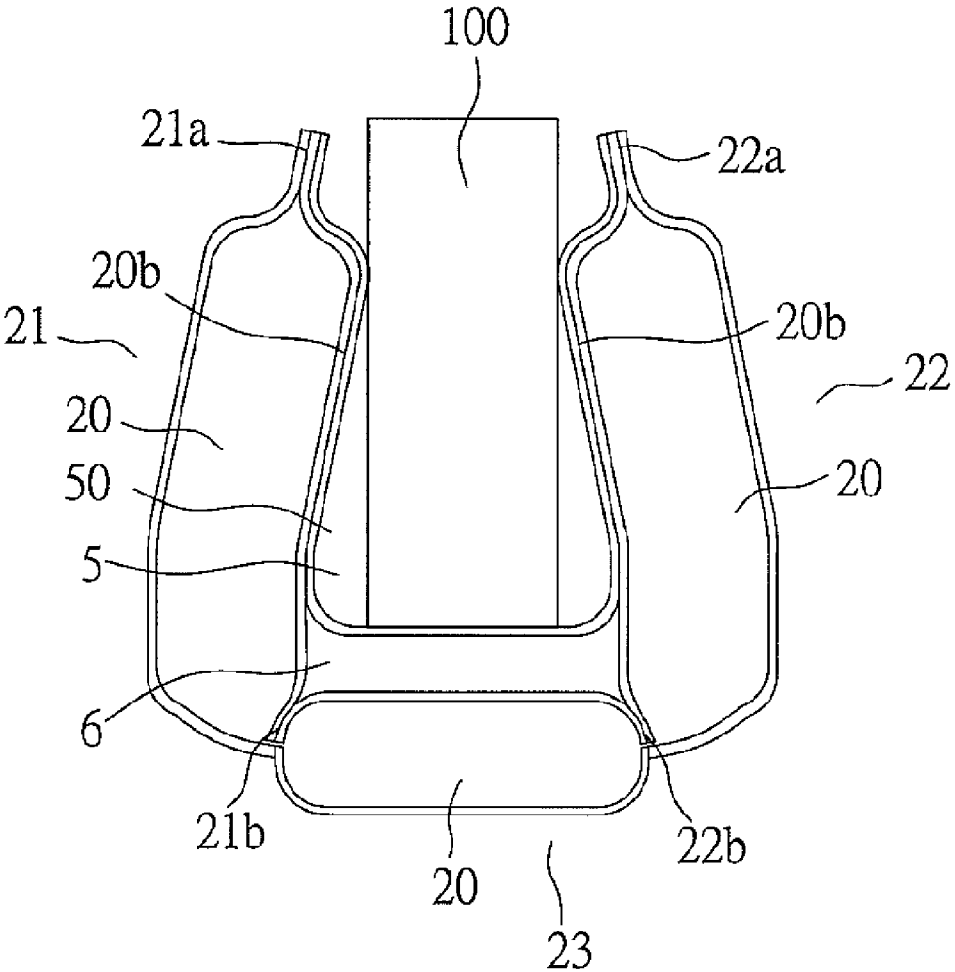
FIG. 13 is a second cross-sectional view of the hammock-type vibration-absorbing air sheath showing the same receiving an article according to the fourth preferred embodiment of the present invention.

Referring now to FIGS. 9, 10, 11, 12, and 13, a hammock-type vibration-absorbing air sheath according to a fourth preferred embodiment of the present invention is illustrated; wherein FIG. 9 is a plane view before inflation with air (or a suitable gas), FIG. 10 is a perspective view after air inflation, FIG. 11 is a side view after air inflation, FIG. 12 is a first cross-sectional view before receiving an article, and FIG. 13 is a second cross-sectional view when receiving the article.

As shown, the hammock-type vibration-absorbing air sheath comprises an air-column sheet 2 which is constructed with a plurality of air columns 20. The air columns 20 are formed with a plurality of first nodes 21*b* and a plurality of second nodes 22*b*. The air columns 20 can be bent along the first nodes 21*b* and the second nodes 22*b* to define a first buffering wall 21, a second buffering wall 22, and a third buffering wall 23, wherein the first buffering wall 21 and the second buffering wall 22 are in communication with each other via the third buffering wall 23. The first buffering wall 21 is provided with a first heat-sealed edge 21*a* on a side edge thereof. The second buffering wall 22 is provided with a second heat-sealed edge 22*a* on a side edge thereof. The first buffering wall 21 can be bent along the first nodes 21*b*, and the second buffering wall 22 can be bent along the second nodes 22*b*. Then, the first heat-sealed edge 21*a* and the second heat-sealed edge 22*a* can be connected to each other by heat sealing means, so as to define a receiving space 6 between the first buffering wall 21 and the second buffering wall 22. The receiving space 6 is substantially quadrilateral, and the shape thereof can be slightly varied with the locations and numbers of the first nodes 21*b* and the second nodes 22*b*, or with bending angles of the first buffering wall 21 and the second buffering wall 22. For example, the shape of the receiving space 6 can be varied with the extent to which the first buffering wall 21 is bent along the first nodes 21*b*, or with the extent to which the second buffering wall 22 is bent along the second nodes 22*b*. In the fourth preferred embodiment of the present invention, the buffering sheet 5 has a first side edge connected to the first buffering wall 21 via the first heat-sealed edge 21*a* by heat sealing means, and a second side edge connected to the second buffering wall 22 via the second heat-sealed edge 22*a* by heat sealing means. Furthermore, the buffering sheet 5 having the two heat-sealed side edges is partially heat-sealed along a plurality of air column lines 20*b* of the first buffering wall 21 and the second buffering wall 22 by heat sealing means. Thus, the buffering sheet 5 is suspended within the receiving space 6 and substantially similar to a hammock structure. Meanwhile, the buffering sheet 5 has a central portion defining an accommodating space 50 for accommodating an article 100, which can be protected with a buffering of the first buffering wall 21, the second buffering wall 22, and the third buffering wall 23.

Figure 14:
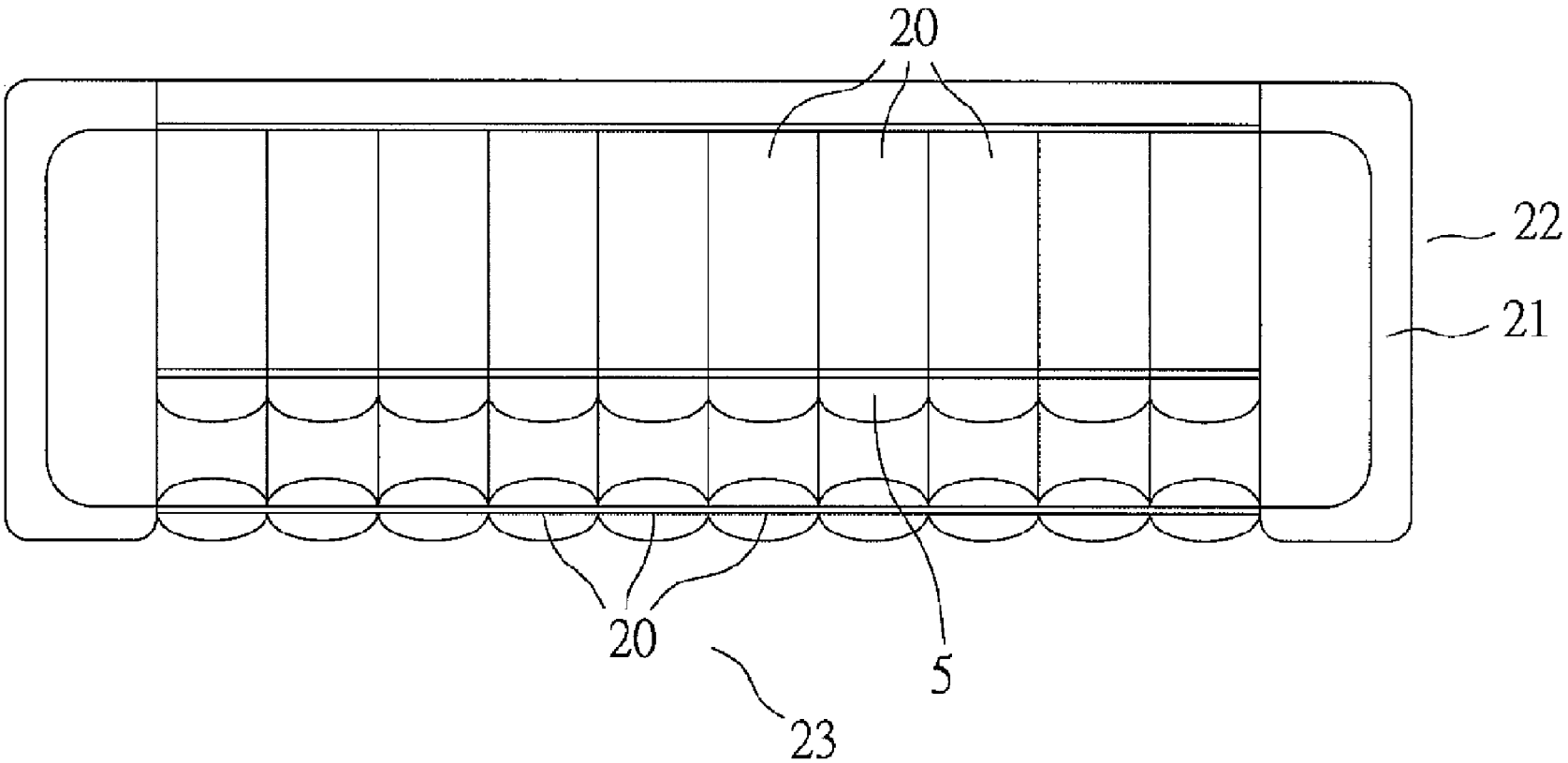
FIG. 14 is a side view of a hammock-type vibration-absorbing air sheath after air inflation according to a fifth preferred embodiment of the present invention.
Figure 15:
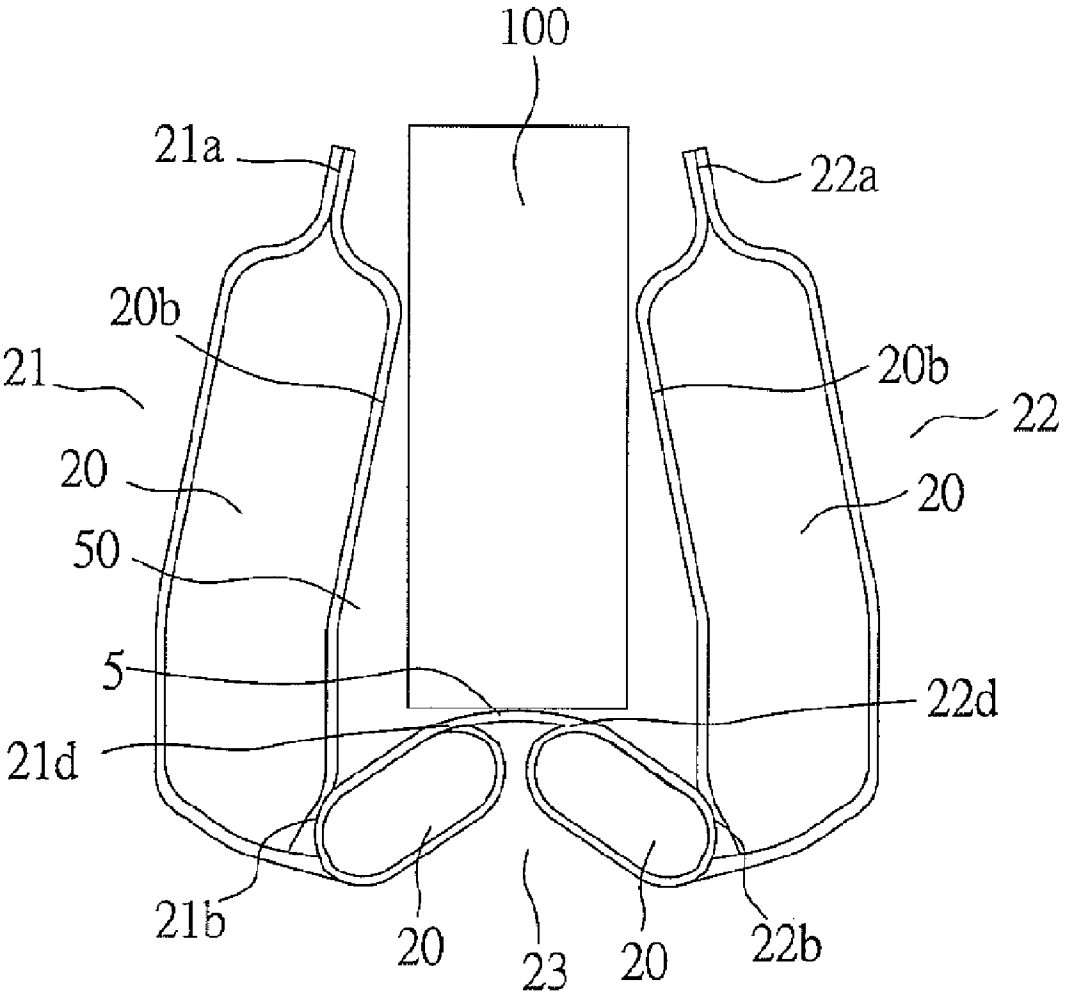
FIG. 15 is a cross-sectional view of the hammock-type vibration-absorbing air sheath showing the same receiving an article according to the fifth preferred embodiment of the present invention.

Referring now to FIGS. 14 and 15, a hammock-type vibration-absorbing air sheath according to a fifth preferred embodiment of the present invention is illustrated. FIG. 14 is a side view after air inflation, wherein a buffering sheet 5 is bent inward; and FIG. 15 is a cross-sectional view when receiving an article.

As shown, the hammock-type vibration-absorbing air sheath comprises an air-column sheet 2 and the buffering sheet 5.

The buffering sheet 5 has a first side edge connected to a first bottom edge 21*d* by heat sealing means, and a second side edge connected to a second bottom edge 22*d* by heat sealing means, so that a bottom portion of the buffering sheet 5 is suspended.

In other words, when the article 100 is protected by the hammock-type vibration-absorbing air sheath, the periphery of the article 100 is doubly protected by the air columns 20 of the first buffering wall 21 and the second buffering wall 22 and the accommodating space 50. Meanwhile, a bottom of the article 100 is protected by the air columns 20 of the third buffering wall 23. The buffering sheet 5 can hold the article 100 to prevent it from escaping from between the air columns 20 of the third buffering wall 23.

The fifth preferred embodiment of the present invention is different from the fourth preferred embodiment in two ways: the buffering sheet 5 in the fifth embodiment is smaller in size and is heat-sealed at a lower position. The smaller buffering sheet 5 is effective in reducing material cost, while a change in the heat-sealed position can still provide a hammock structure with a suspended bottom.

In the fourth preferred embodiment of the present invention, the periphery and the bottom of the article 100 are in contact with the buffering sheet 5. In the fifth preferred embodiment of the present invention, the periphery of the article 100 is in contact with the air columns 20 of the first buffering wall 21 and the second buffering wall 22, while the bottom of the article 100 is in contact with the buffering sheet 5.

The air-column sheet 2 in formed by two outer films 2*a*, 2*b* connected to each other by heat sealing means, as described in the first preferred embodiment. The two outer films 2*a*, 2*b* can be preferably made of polyethylene (PE).

The buffering sheet S is made of a flexible material, such as polyvinylchloride (PVC), polypropylene (PP), expanded polyethylene (EPE), expanded polypropylene (EPP), fabric, foam material, polyethylene (PE) sheet provided with small air bubbles projecting therefrom, corrugated paper, paper, or paper-like material.

According to the present invention, the hammock-type vibration-absorbing air sheath further comprises an air-filling channel 9, wherein the two outer films 2*a*, 2*b* are connected to each other by heat sealing means, as described in the first preferred embodiment, so as to define an air flowing space therebetween, i.e., the air-filling channel 9.

The air-filling channel 9 is formed on the side edge of the first buffering wall 21. After the air flows through an air-filling opening 9*a* and finishes inflating the air-filling channel 9, the two outer films 2*a*, 2*b* must be pulled outward and away from each other, so that the air will be filled into the air columns 20 along the air channel 14 for inflating the air columns 20. Thus, the air will be filled into and thereby inflate the first buffering wall 21, the second buffering wall 22, and the third buffering wall 23, so as to provide the vibration-absorbing buffering effect.

According to the structure described in the fourth preferred embodiment of the present invention, the buffering sheet 5 having the two heat-sealed side edges is partially connected to the air column lines 20*b* by heat sealing means, while the buffering sheet 5 is not heat-sealed along a middle portion of the air column lines 20*b*, so that a bottom portion of the buffering sheet 5 is suspended. Furthermore, the buffering sheet 5 and the third buffering wall 23 are spaced by an interval defined by the receiving space 6 formed therebetween, so as to prevent the buffering sheet 5 from being directly in contact with the air columns 20 close to the third buffering wall 23. Because the buffering sheet 5 is partially connected to the air column lines 20*b* of the first buffering wall 21 and the second buffering wall 22, air pressure resulting from air inflation presses side surfaces of the buffering sheet 5 tightly against the air columns 20 of the first buffering wall 21 and the second buffering wall 22. As a result, the accommodating space 50 formed by the buffering sheet 5 can provide a better packaging effect.

In other words, when the article 100 is protected by the hammock-type vibration-absorbing air sheath, the periphery of the article 100 is doubly protected on both sides by the air columns 20 of the first buffering wall 21 and the second buffering wall 22 and the accommodating space 50. Meanwhile, the bottom of the article 100 is doubly protected by the receiving space 6 and the air columns 20 of the third buffering wall 23. When the article 100 is accommodated into the accommodating space 50 of the buffering sheet 5, an upper portion of the first buffering wall 21 and the second buffering wall 22 will be drawn by the buffering sheet 5 being compressed, and therefore incline inward, so as to clamp and hold the article 100 more securely is place.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A hammock-type vibration-absorbing air sheath for packaging an article to provide a buffering protection, comprising:

a first buffering wall having at least one first heat-sealed edge, wherein the first buffering wall is partitioned into a plurality of air columns by a plurality of air column lines which are vertical to the first heat-sealed edge and formed by heat sealing means;

a second buffering wall having at least one second heat-sealed edge connected to the at least one first heat-sealed edge by heat sealing means, wherein the second buffering wall is partitioned into a plurality of air columns by a plurality of air column lines which are vertical to the second heat-sealed edge and formed by heat sealing means;

at least one first node formed on the first buffering wall such that the first buffering wall can be bent along the first node;

at least one second node formed on the second buffering wall such that the second buffering wall can be bent along the second node;

a third buffering wall connected between the first buffering wall and the second buffering wall and formed by bending the first buffering wall and the second buffering wall;

a receiving space formed between the first buffering wall and the second buffering wall by bending the first buffering wall and the second buffering wall; and a buffering sheet having a first side edge connected to the first buffering wall via the first heat-sealed edge by heat sealing means, and a second side edge connected to the second buffering wall via the second heat-sealed edge by heat sealing means, wherein the buffering sheet having the two heat-sealed side edges is partially heat-sealed along the air column lines of the first buffering wall and the second buffering wall by heat sealing means, so that the buffering sheet is suspended within the receiving space for receiving the article, wherein the buffering sheet is used to absorb vibrations of the article, while the first buffering wall, the second buffering wall, and the third buffering wall are used to protect the article with a buffering effect.

2. The hammock-type vibration-absorbing air sheath of claim 1, wherein the buffering sheet is not heat-sealed along a middle portion of the air column lines, so that a bottom portion of the buffering sheet is suspended.

3. The hammock-type vibration-absorbing air sheath of claim 1, wherein the buffering sheet includes a plurality of air columns, and the air sheath further comprises an air-filling channel formed on a side edge of the first buffering wall for filling air into the air columns of the first buffering wall, wherein the air-filling channel is in communication with the second and third buffering walls through the nodes on the air columns.

4. The hammock-type vibration-absorbing air sheath of claim 3, further comprising a serial check valve system used to communicate the air-filling channel with the first, second and third buffering walls, which are connected via the first and second nodes, wherein air in the air-filling channel is flowed into the air columns of the first buffering wall through the serial check valve system, and the serial check valve system can seal an air inlet, so as to prevent the air in the air columns of the first, second and third buffering walls, which are connected via the first and second nodes, from leaking out.

5. The hammock-type vibration-absorbing air sheath of claim 1, further comprising an accommodating space formed by folding the buffering sheet in half.

6. The hammock-type vibration-absorbing air sheath of claim 1, further comprising two connection portions formed on two ends of the buffering sheet by bending the buffering sheet in half and connecting folded halves of the two ends, respectively.

7. The hammock-type vibration-absorbing air sheath of claim 1, wherein the first buffering wall further comprises a first bottom edge substantially vertical to the first heat-sealed edge, and the second buffering wall further comprises a second bottom edge substantially vertical to the second heat-sealed edge, wherein the first bottom edge and the second bottom edge are connected to each other by heat sealing means, so as to seal the receiving space.

8. The hammock-type vibration-absorbing air sheath of claim 7, wherein an interval is defined between the buffering sheet and a heat-sealed connection portion between the first bottom edge and the second bottom edge.

9. The hammock-type vibration-absorbing air sheath of claim 1, wherein the first buffering wall further comprises a first connection edge substantially vertical to the first heat-sealed edge, and the second buffering wall further comprises a second connection edge substantially vertical to the second heat-sealed edge, and wherein two side edges of the buffering sheet are attached to the first connection edge and the second connection edge, respectively.

10. The hammock-type vibration-absorbing air sheath of claim 1, wherein a shape of the receiving space changes with positions of the buffering walls attached by heat sealing means.

11. The hammock-type vibration-absorbing air sheath of claim 1, wherein a side edge of the first buffering wall is partially extended through heat-sealed nodes and bent toward a bottom thereof for connecting to the buffering sheet by heat sealing means, so as to form an assembly wherein the first buffering wall is at an upper portion and the buffering sheet is at a lower portion.

12. The hammock-type vibration-absorbing air sheath of claim 1, wherein a side edge of the second buffering wall is partially extended through heat-sealed nodes and bent toward a bottom thereof for connecting to the buffering sheet by heat sealing means, so as to form an assembly wherein the second buffering wall is at an upper portion and the buffering sheet is at a lower portion.

13. The hammock-type vibration-absorbing air sheath of claim 12, wherein the buffering sheet is a polyethylene (PE) sheet, a polyethylene (PE) composite sheet, or a plastic sheet.

14. The hammock-type vibration-absorbing air sheath of claim 1, wherein each of the buffering walls comprises a plurality of buffering air columns each having a serial check valve system, and the buffering air columns can have different shapes and sizes, wherein the shapes of the buffering air columns can be linear or non-linear.

15. The hammock-type vibration-absorbing air sheath of claim 7, wherein the first side edge of the buffering sheet is connected to the first bottom edge by heat sealing means.

16. The hammock-type vibration-absorbing air sheath of claim 7, wherein the second side edge of the buffering sheet is connected to the second bottom edge by heat sealing means.

* * * * *